United States Patent [19]

Evendon

[11] Patent Number: 4,958,264

[45] Date of Patent: Sep. 18, 1990

[54] HELMET LAMP

[75] Inventor: Jean J. Evendon, 12 Springdale, Barkham Wood, Wokingham, Berkshire RG11 4RZ, England

[73] Assignee: Jean J. Evendon, Wokingham, England

[21] Appl. No.: 404,406

[22] Filed: Sep. 8, 1989

[51] Int. Cl.[5] ..... F21L 15/14

[52] U.S. Cl. ..... 362/106; 2/209.2; 2/422; 362/191; 362/396

[58] Field of Search ..... 362/105, 106, 107, 190, 362/191, 396; 2/209.2, 422

[56] References Cited

U.S. PATENT DOCUMENTS

| | | | |
|---|---|---|---|
| 4,092,704 | 5/1978 | Malm | 362/106 |
| 4,332,004 | 5/1982 | Slaughter | 362/106 X |
| 4,530,112 | 7/1985 | Cecala et al. | 362/105 X |

*Primary Examiner*—Stephen F. Husar

*Attorney, Agent, or Firm*—Finnegan, Henderson, Farabow, Garrett & Dunner

[57] ABSTRACT

A lamp is provided for use with a protective helmet (20) having a visor (21) mounted thereon by means of pivots (22). The lamp comprises a band (1) adapted to extend around the back of the helmet (20) and securing means (4,5) whereby the ends of the band (1) can be releasably secured to the pivots (22) of the visor (21).

15 Claims, 2 Drawing Sheets

HELMET LAMP

The present invention relates to lamps and more particularly to a lamp for use with a protective helmet having a pivotable visor.

Lamps are known which comprise a band adapted to fit around the head of a user so that the lamp can be worn on the head to leave both hands free. Such lamps are normally worn with the head of the lamp, i.e., that part of the lamp comprising the reflector and bulb, substantially in the centre of the forehead of the wearer. These known lamps are suitable for use with most protective hats and helmets but cannot be used with a protective helmet having a pivotable visor which can be moved between an in-use position in which the visor extends over and protects the face of a wearer and an out-of-use position in which the visor is positioned over the crown of the helmet because the lamp interferes with the movements of the visor.

The present invention has as its object to provide a lamp which is suitable for use with a protective helmet having a pivotable visor.

The present invention provides a lamp for use with a protective helmet having a pivotable visor, the lamp comprising a band adapted to extend around the back of a helmet and securing means whereby the ends of the band can be releasably secured to the pivots of the visor.

Said securing means may each comprise a flexible member which can be passed around the pivot of a visor and secured. Said band may have a buckle at each end thereof and each said buckle may have a said flexible member secured by one end thereto. The other end of each flexible member may be releasably securable to its associated buckle by hook means, such as a hook at said other end of the flexible member which is engageable with an aperture in its associated buckle or a loop at said other end of the flexible member which is engageable with a hook on its associated buckle. The flexible members may each comprise a length of cord, wire, e.g., plastics coated wire, or the like.

Said band may be a flexible band and is preferably an elasticated band, e.g., formed from an elasticated webbing or the like.

Said buckles may be such as to enable the effective length of the band to be adjusted and the head of the lamp may be mounted on one of said buckles. Said one buckle may have a lateral extension thereon on which the head of the lamp is mounted. Advantageously, the head of the lamp is mounted on the end of a post extending outwardly of said one buckle. Said post may be rotatable about its axis relative to said one buckle and the head of the lamp may be pivotably mounted on the post so as to be pivotable about an axis at right angles to the axis of the post, thereby enabling the head of the lamp to be adjusted to direct a beam of light from the lamp in a required direction.

At least one battery holder may be mounted on said band and be electrically connected to the head of the lamp as by means of insulated electrical conductor wires. If desired at least one container for spare parts, such as spare bulbs, may be provided on said band.

Said band may have thereon at least one hook member engageable with the lower rear edge of a said protective helmet to prevent the lamp from riding up on the helmet.

The invention will be more particularly described with reference to the accompanying drawings, in which.

Figure 1:
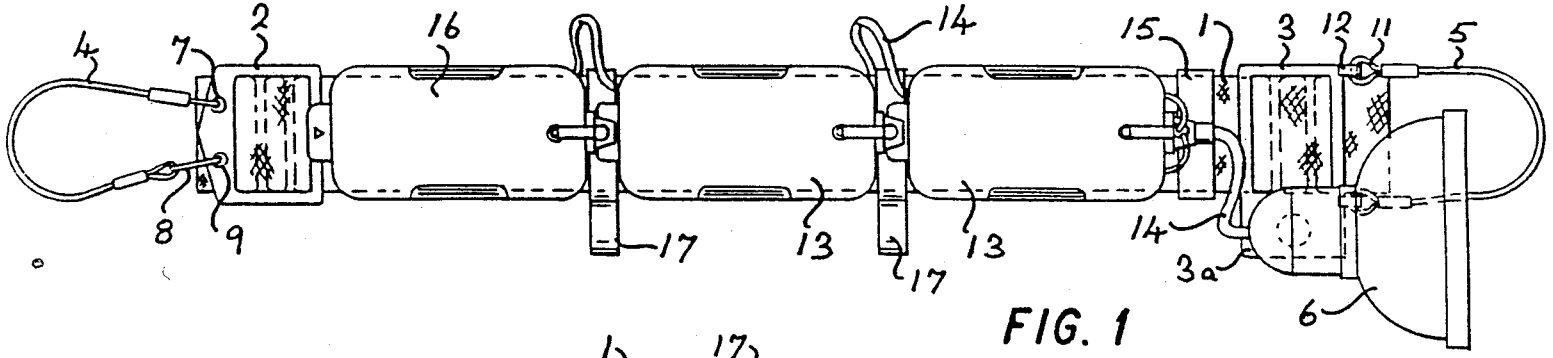
FIG. 1 is a plan view of a lamp according to the present invention.
Figure 2:
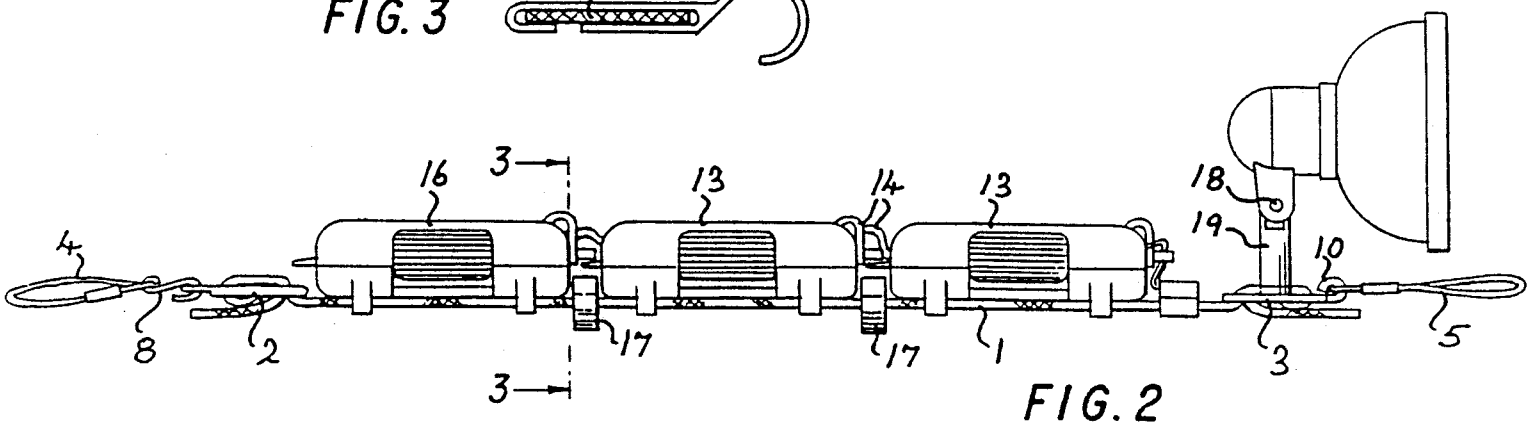
FIG. 2 is a side elevation of the lamp of FIG. 1.

Referring to the drawings it will be seen that the lamp illustrated therein comprises a flexible elasticated band 1 having buckles 2, 3 at opposite ends thereof whereby the effective length of the band 1 can be adjusted, flexible members 4, 5 attached to the buckles 2, 3 respectively and a lamp head 6 mounted on an extension 3*a* of the buckle 3.

The flexible member 4 is permanently secured at one end to an aperture 7 in the buckle 2 and at its other end carries a hook member 8 engageable with an aperture 9 in the buckle 2. The flexible member 5 is permanently secured at one end to a clenched-over hook portion 10 of the buckle 3 and at its other end has a loop 11 engageable with a hook portion 12 of the buckle 3.

Mounted on the band 1 are battery containers 13 which are electrically connected to the lamp head 6 by means of insulated electrical conductor leads 14 one of which extends to the lamp head 6 by way of a cable clip 15 provided on the band 1. Also provided on the band 1 is a container 16 for spare parts, such as spare bulbs.

Figure 3:
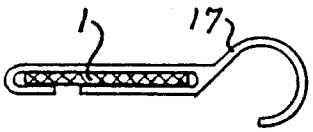
FIG. 3 is a sectional view on line A—A of FIG. 2 of a hook member provided on the band of the lamp.

A pair of hook members 17, one of which is shown in FIG. 3, are provided on the band 1 and are engageable with the lower rear edge of a protective helmet as will be explained more fully hereinafter.

The lamp head 6 is pivotably mounted by means of a pin 18 on the outer end of a post 19 mounted on the extension 3*a* of the buckle 3. The post 19 is so mounted on the extension 3*a* as to be pivotable about its own axis and this pivotal movement combined with the pivotal movement of the lamp head 6 about the pin 18 enables the lamp head 6 to be adjusted to direct the beam of light therefrom in a required direction.

The lamp illustrated is for use with a protective helmet 20 having a visor 21 pivotably mounted thereon by means of pivots 22. The visor 21 is movable between an in-use position in which the visor extends over the face of a wearer of the helmet 20 to an out-of-use position in which the visor is located over the crown of the helmet 20, these positions being determined by stops 23 on plates 24 mounted on either side of the helmet.

Figure 4:
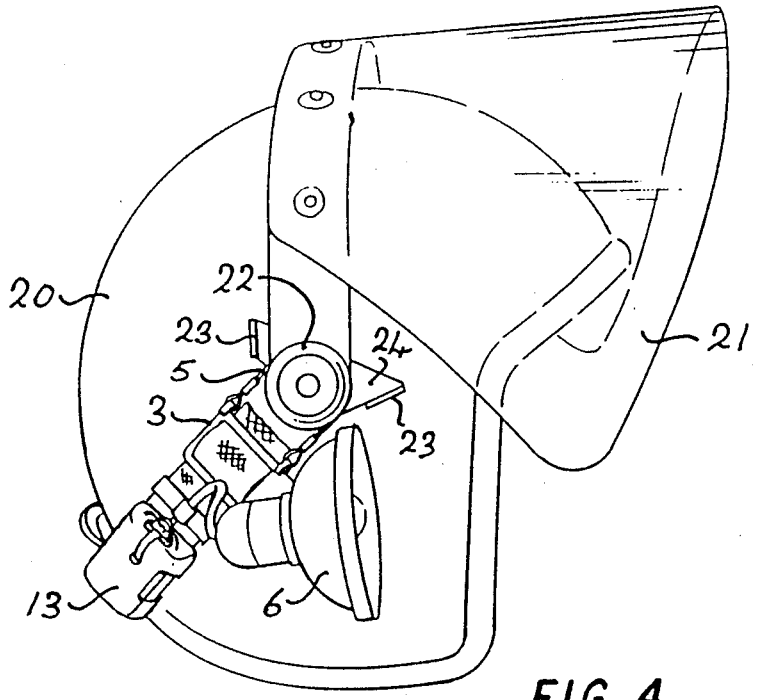
FIG. 4 is a side elevation of a protective helmet having a lamp according to the present invention mounted thereon and, FIG. 5 is a perspective view of the protective helmet and lamp of FIG. 4.
Figure 5:
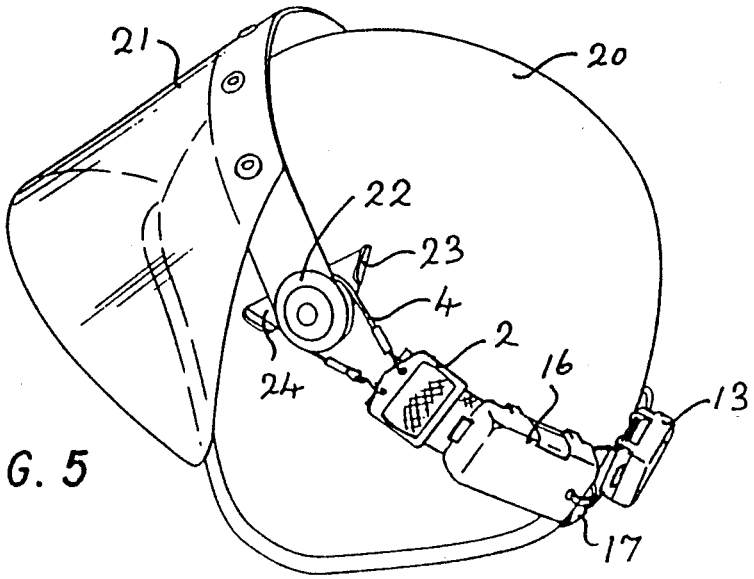

As will be seen from FIGS. 4 and 5 the lamp of the present invention is mounted on the helmet 20 by engaging the flexible members 4, 5 around the pivots 22 of the visor 21 so that the band 1 extends around the back of the helmet 20. The hook members 17 are engaged with the lower rear edge of the helmet 20 as shown in FIG. 5 to prevent the band 1 from riding up on the helmet 20. With the lamp 1 mounted on the helmet 20 in this way the lamp head 6 is positioned on one side of the helmet and can be adjusted by rotation about the axes of the pin 18 and post 19 to direct the beam of light therefrom in a required direction. The post 19 holds the lamp head 6 away from the protective helmet 20 so that the lamp head 6 does not interfere with the normal use of the visor 21. Likewise, because the band 1 extends from the pivots 22 around the back of the helmet 20, there is no interference with the normal use of the visor 21.

What is claimed:

1. A lamp for use with a protective helmet having a pivotable visor, the lamp comprising a band extending around a back portion of the helmet and securing means at each end of the band releasably secured to pivots of the visor and a light source mounted on the band.

2. A lamp according to claim 1, wherein each said securing means comprises a flexible member which can be passed around one of the pivots of the visor and secured.

3. A lamp according to claim 1, wherein said band has a buckle at each end thereof, each said buckle has a flexible member secured by one end thereto, and each said flexible member is releasably securable to its associated buckle by hook means after having been passed around one of the pivots of the visor.

4. A lamp according to claim 3, wherein at least one said flexible member has a hook at another end thereof engageable with an aperture in its associated buckle.

5. A lamp according to claim 3, wherein at least one said flexible member has a loop at another end thereof engageable with a hook on its associated buckle.

6. A lamp according to claim 1, wherein said band is a flexible elasticated band.

7. A lamp according to claim 3, wherein each said buckle enables the effective length of the band to be adjusted.

8. A lamp according to claim 3, wherein the light source is mounted on one said buckle.

9. A lamp according to claim 8, wherein said one buckle has a lateral extension thereon on which the light source is mounted.

10. A lamp according to claim 8, wherein the light source is mounted on an end of a post extending outwardly of said one buckle.

11. A lamp according to claim 10, wherein said post is rotatable about its axis relative to said one buckle and wherein the light source is pivotably mounted on the post so as to be pivotable about an axis at right angles to the axis of the post.

12. A lamp according to claim 1, wherein at least one battery holder is mounted on said band and is electrically connected to the light source by insulated electrical conductors.

13. A lamp according to claim 1, wherein at least one container for spare parts is provided on said band.

14. A lamp according to claim 1, wherein there is provided on said band at least one hook member engageable with a lower rear edge of said protective helmet to prevent the light source from riding up on the helmet.

15. A lamp for use with a protective helmet having a pivotable visor, the lamp comprising a flexible band adapted to extend around the back of a helmet, a buckle at each end of the band whereby the band can be adjusted for length, a flexible member secured by one end to each of said buckles and releasably securable at its other end to the buckle by hook means after having been passed around a pivot of the visor, whereby to secure the band to the helmet, a post extending outwardly of one of said buckles, and a lamp head mounted on the outer end of the post, the post being rotatable about its axis relative to said one buckle and the head of the lamp being pivotally mounted on the post so as to be pivotable about an axis at right angles to the axis of the post.

* * * * *